CHALK LINE DEVICE

BACKGROUND OF THE INVENTION

1. Field of the Invention

This invention relates to chalk line devices used for establishing a line between two points during construction work by the employment of a flexible string or line carrying chalk.

2. Brief Description of the Prior Art

A number of devices have heretofore been proposed for use by carpenters and in similar trades for the purpose of establishing an identifiable marked out line between two points. One of the most widely used of these devices is a chalk line device which includes a chalk-containing housing which also contains a reel upon which a flexible string or the like is reeled, and is paid out through a hole in one end of the chalk-containing housing. At its end outside the housing, the string will usually carry some type of ring or clip which will permit that end of the string to be secured in a fixed positon. The housing can then be drawn away from the outer end of the string, after it is fixed in place, to a second location to which it is desired to establish a marked line. As the housing is moved away from the anchored end of the chalk line, the line is paid out from the reel and in moving through the body of chalk dust carried within the housing, picks up a significant amount of chalk which adheres to the line. After the two points between which the line is to be established have been determined, and the housing then placed at one end and the free end of the string at the other, the string can be snapped to cause the chalk to be jarred therefrom and left in a line corresponding to the extension of the string between the two points.

Although the chalk line device, per se, is old in the art, in recent times several improvements on these very useful adjuncts to the carpenter's trade have been developed. Thus, in U.S. Pat. No. 2,589,500 to Linden et al., the housing which contains the chalk dust and the reel upon which the chalk line is stored is made in a shape or configuration which permits it to be used as a plumb bob. This can be accomplished by reeling out the chalk line carrying a loop or ring at its free end outside the housing to a point where the line can be suspended from an overhead location, and the housing permitted to swing pendulum fashion from such point of suspension. The lower end of the housing comes to rest over a point which is directly below, and in vertical alignment with, the anchored free end of the chalk line.

This form of the chalk and reel housing has been retained in a more recent type of chalk line device as shown in Landen U.S. Pat. No. 2,749,618. The Landen patent includes a quick opening and closing pivoted plate which is mounted through an opening at one side of the chalk box to permit the box to be quickly refilled with chalk dust at a time when the supply has become exhausted through use of the device.

In U.S. Pat. No. 3,126,637 to Short, a dual line chalk box is provided which contains a pair of reels disposed on opposite sides of a chamber containing the chalk dust, with the respective chalk lines carried on these reels being paid out through openings formed in opposite ends of the housing. By dividing the chamber in which the two reels are located into two separate chambers, two colors of chalk dust may be utilized so that the two chalk lines snapped at different places or for different purposes may be distinguished by the use of either one of the lines, according to the color of chalk dust carried thereby.

More recent improvements in chalk line devices are depicted in U.S. Pat. No. 3,438,595 to Brown et al. and U.S. Pat. No. 3,888,018 to Hyde et al.

GENERAL DESCRIPTION OF THE PRESENT INVENTION

The present invention comprises a chalk line device for storing and dispensing a chalk line, and which is also functional as a plumb bob and as an arc scribing instrumentality. Both of the latter functions are extremely valuable in carpentry and various construction trades, and impart flexibility and advantage to the use of the chalk line device of the present invention as compared to those which have heretofore been proposed.

Broadly described, the chalk line device of the invention includes a pair of cooperating side plates which fit together to form a hollow housing. On the interior of the housing, a chalk dust and reel-receiving chamber is disposed and there are openings in the housing located at opposite ends of this chamber. Centrally mounted within the housing is a chalk line reel which has stored thereupon, an elongated flexible chalk line which projects through the opening at one end of the housing. An arc scribing disk is mounted in the opening at the other end of the housing, so that a part of the disk projects through this opening and a part is within the housing. Chalk carrying felt pads are disposed on opposite sides of the opening in which the arc scribing disk is located so that as the disk is rotated about a supporting shaft, it continuously picks up chalk dust from the felt pads and is capable of marking or scribing an arc of a given radius when the free end of the chalk line which is extended through the opening in the other end of the housing is anchored.

An important object of the present invention is to provide a chalk line device which can be utilized in the conventional fashion for snapping a chalk line between two predetermined points, but which can also be used as a plumb bob for establishing a vertical line between two points, or as an arc scribing device for scribing arcs on substantially any flat surface, with the arcs being of a predetermined or selected radius.

A further object of the invention is to provide an improved chalk line device which is compact in construction and is susceptible to extended usage over long periods of time without malfunction.

Another object of the invention is to provide a versatile tool for use in construction where it is necessary to measure angles, mark out arcs of predetermined radii, establish a chalked line between two predetermined points or establish a vertical line between two vertically spaced points.

Additional objects and advantages of the invention will become apparent as the following detailed description of a preferred embodiment of the invention is read in conjunction with the accompanying drawings which illustrate such preferred embodiments.

GENERAL DESCRIPTION OF THE DRAWINGS

FIG. 1 is a side elevation view of the chalk line device of the invention as it appears when viewed from one side thereof.

FIG. 2 is a sectional view taken along line 2—2 of FIG. 1.

FIG. 3 is a sectional view taken along line 3—3 of FIG. 1.

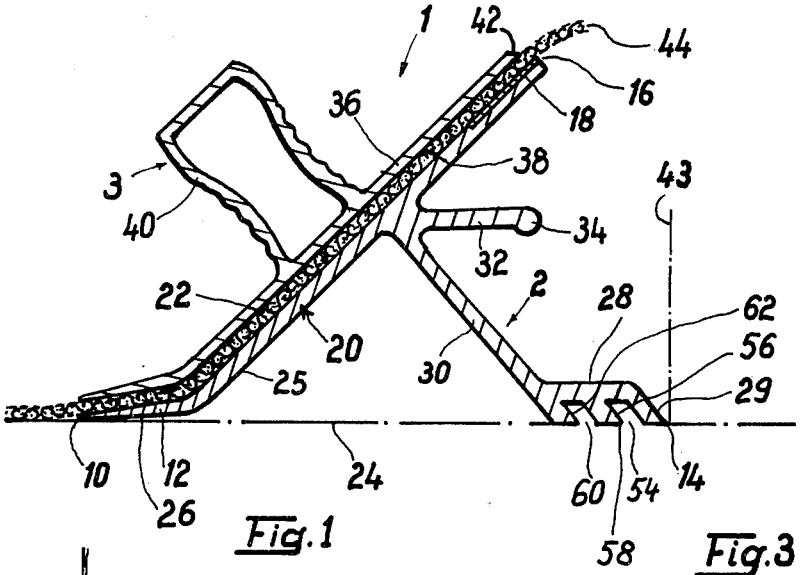
Fig. 1
Fig. 2
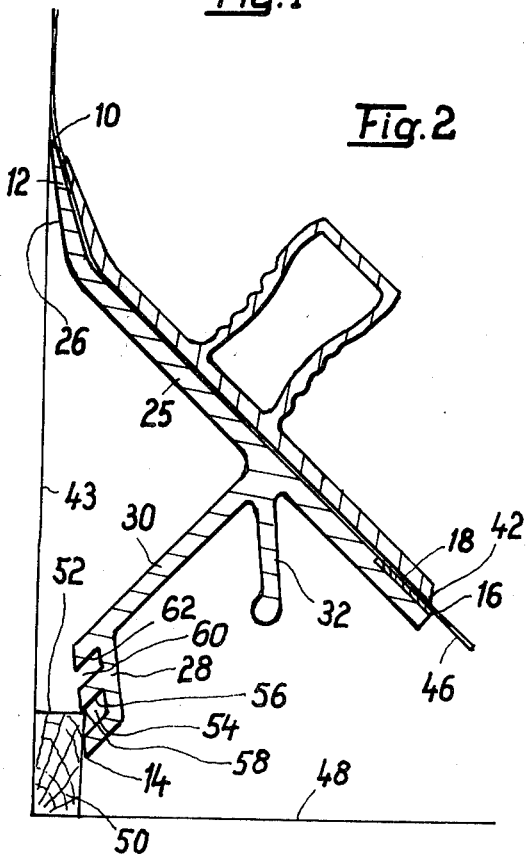
Fig. 3
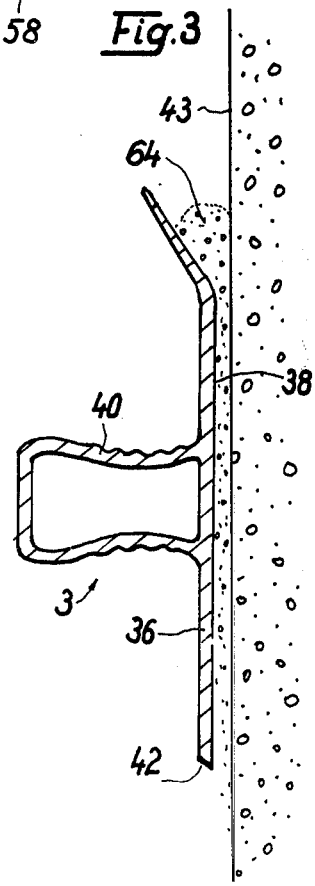

AUXILIARY DEVICE FOR LAYING FLEXIBLE WALL AND FLOOR COVERINGS

The present invention relates to an auxiliary device for laying flexible wall and/or floor coverings. More particularly, it relates to such a device having an elongated angle plate having a supporting surface for the material to be cut to size, a cutting edge defined at one end of the supporting surface, and a locating edge disposed parallel to the cutting edge.

An auxiliary device of this kind is disclosed, for example, in British Pat. No. 851,088. In this case, the auxiliary device is in the form of an elongated angle plate, the two legs of which are approximately at right angles to each other. This known device is designed to cut wallpaper to size, with the outer edge of one leg, which serves as the locating edge, being placed against the reference line defining the area to be papered at right angles to the direction of the wallpaper; for example, against the upper edge of the skirting board. With the paper being already partially secured to the wall, the end to be cut is then pressed against the inside corner of the angle plate, and the cut is then made along this inside corner. Appropriate arching of the leg of the angle plate bearing against the wall compensates at least for the thickness of the other leg of the angle plate located between the reference line and the inside corner of the angle plate, so that, after removal of the angle plate, the cut paper can be fitted to the wall along the reference line.

This device has numerous disadvantages and has therefore been found unsatisfactory in practice. One obvious disadvantage is that this device is difficult to handle since, while it is in use, it can be grasped and held only by the ends of the angle plate. Another disadvantage is that the paper to be cut to size must be bent sharply along the inside edge of the device if an accurate cut is to be made, which makes the device suitable for cutting to size only relatively thin material, such as wallpaper, but not floor coverings. Another disadvantage is that the cutting tool can penetrate into the material only as far as the thickness thereof, since the material on both sides of the cut rests upon the corner of the angle plate. In practice, therefore, the paper is actually more torn than cut. The cut is therefore not clean and tearing may thus occur along the parting edge, especially in the case of wet paper to which paste has been applied.

It is the object of the invention to design a device of the aforementioned type, in such a manner as to overcome the disadvantages outlined above, i.e. the device is to be easy to handle, it is to be suitable for cutting to size not only wallpaper but also floor coverings and other similar types of thick materials, and the cutting tool is to be able to penetrate fully into the material being cut, and to project on both sides of the material in order to produce a clean cut.

This object is achieved in accordance with the present invention, in that the angle plate, in cross section, lies substantially within a triangle, the locating edge, the cutting edge, and the supporting edge thereof, each passing through one corner of the triangle. The angle plate has a supporting surface for the wall or floor covering which runs, from a plane passing through the supporting and locating edges, initially in the form of a wedge, and then ascending more steeply to the cutting edge; the distance, as measured along the supporting surface, between the supporting edge and the cutting edge, is equal to the distance, as measured in this plane, between the supporting edge and the locating edge. A separate pressure strip is provided which is approximately of the same length as the angle plate, and has a pressure surface, the cross-sectional profile of which is designed to complement the profile of the supporting surface of the angle plate.

This auxiliary device may be applied to the wall or floor surface to be covered in such a manner that the locating and supporting edges rest upon the area to be covered; the locating edge being aligned with the reference line, so that the material to be cut to size is lifted, in the vicinity of the supporting edge, from the wall or floor surface and is caused to ascend obliquely over the cutting edge. The device may be conveniently held between the locating and cutting edges, since a grip can be provided in this area. Since the supporting surface initially departs from the wall surface in the form of a wedge at a very acute angle and only subsequently rises more steeply, and since the covering resting upon the supporting surface can project, without any change in direction, beyond the cutting edge, relatively thick coverings may be placed upon the supporting surface without in any way impairing the accuracy of the cut. The cutting tool can pass completely through the covering in the vicinity of the cutting edge and can project adequately from both sides, thus ensuring a clean cut.

According to one advantageous embodiment of the auxiliary device, the part of the angle plate adjacent the locating edge is provided, with at least one groove disposed parallel to the locating edge, located between the locating edge and the supporting edge. If the auxiliary device is rested with this groove upon the skirting board, instead of the locating edge, then the covering material is cut larger by an amount corresponding to the distance between the locating edge and the groove. This may be of advantage if, for example, the covering is to be applied not only as far as the skirting board, but also to the top surface thereof adjoining the wall surface to which the covering is to be applied.

According to another advantageous embodiment, the angle plate comprises a plate-like section running between the supporting and cutting edges and a web running from the plate-like section to the locating edge. The free end of the web is preferably provided with a foot defining the locating edge. Grooves serving as auxiliary locating edges may, if necessary, be incorporated into this foot.

In one particularly advantageous embodiment, a grip is provided in the angle enclosed by the plate-like section and the web, between the cutting edge and the locating edge and parallel with these edges.

According to still another useful embodiment, a grip running parallel with the edge of the pressure strip is provided on the side remote from the pressure surface.

According to one particularly advantageous embodiment, the an plate and/or the pressure strip are in the form of extruded sections, made, more particularly, of a light alloy.

Finally, it may also be expedient to insert a reinforcing strip, preferably made of hardened high-grade steel, into the angle plate along the cutting edge.

Other objects and features of the present invention will become apparent from the following detailed description when taken in connection with the accompanying drawing which discloses a single embodiment of the invention. It is to be understood that the drawing is designed for the purpose of illustration only, and is not intended as a definition of the limits and scope of the invention discloseed.

In the drawing, wherein similar reference numerals denote similar elements throughout the several views:

FIG. 1 is a cross-sectional view of a novel auxiliary device embodying the present invention, showing it being used in laying a floor covering;

FIG. 2 is a cross-sectional view similar to that of FIG. 1, but showing the auxiliary device being used to cut wall-paper to size;

FIG. 3 is a cross-sectional view of the pressure strip shown in the previous Figs. being used to smooth the surface to which wall-paper is to be applied.

Referring now in detail to the drawings, since the auxiliary device according to the invention may easily be produced by cutting an extrusion into suitable lengths, it is unnecessary to show any view of the device other than the cross-section illustrated. It is desirable that the length of the auxiliary device shall correspond to the width of the wall or floor covering to be cut to size.

The auxiliary device according to the invention, generally referred to by reference numeral 1 in the drawing, consists of two matching but separate components, namely a base section or angle plate 2 having a generally T-shaped configuration and a pressure strip 3. Essential to the correct functioning of section 2 are the three parallel, longitudinal edges thereof, namely the supporting edge 10, defining the outer edge of wedge-shaped portion 12, the locating edge 14, and the cutting edge 16. These three edges define the corners of a triangle within which the angle plate 2, in cross section, is inscribed.

Since cutting the covering material involves running the cutting tool along edge 16, base section 2 is reinforced by embedding therein a reinforcing strip 18 preferably made of hardened high-grade steel.

Running from supporting edge 10 to cutting edge 16 is a plate-like section 20 which, in the vicinity of supporting edge 10, merges with the above-mentioned wedge-shaped portion 12. The top surface of section 20 serves as a supporting surface 22 for the wall or floor covering to be cut to size. Wedge-shaped portion 12 is designed in such a manner that its bottom surface 26 defines a very flat, acute angle in relation to a plane 24 passing through supporting edge 10 and locating edge 14. At the end remote from supporting edge 10, section 12 merges into section 25 which ascends steeply in relation to plane 24 constituting the base-plane of the device; the angle between plane 24 and section 25 being approximately 45°. In order to provide supporting edge 10 with a secure hold on the wall or floor, as noted above, bottom surface 26 of base section 12 is at a very small, acute angle relating to plane 24.

Locating edge 14 is arranged at the outer end of a foot 28, the bottom surface of which is defined by plane 24, while outer surface 29 thereof, remote from supporting edge 10, lies approximately in a plane which joins locating edge 14 and cutting edge 16 and rises at an acute angle to plane 24. Foot 28 is connected to plate-like section 20 by means of a web-like leg 30, the arrangement thereof being such that leg 30 and plate-like section 20 form approximately the two sides of an equilateral triangle erected upon plane 24.

Located in the area enclosed by section 20 and leg 30, and between locating edge 14 and cutting edge 16, is an extruded arm constituting a grip member 32, the outer edge 34 of which may be provided with a bead-like thickening which makes it easier to hold. This grip member 32 makes the device much more comfortable to work with. Pressure strip 3, which may also be an extruded section, consists essentially of a plate-like section 36 having a pressure surface 38 facing plate-like section 20; the cross-sectional profile of section 36 being designed to complement the profile of supporting surface 22 including the wedge-shaped portion 12. Fitted to the side of pressure strip 3 remote from pressure surface 38 is grip member 40. Plate-like section 36 of pressure strip 3 terminates in an edge 42 at a short distance before cutting edge 16 which is chamfered at an acute angle so that the movement of the cutting tool is in no way obstructed during the cutting operation.

When in use, the auxiliary device is placed with supporting edge 10 and locating edge 14 upon the surface to be covered with the wall or floor covering, in such a manner that the surface to be covered and base-plane 24 of the device coincide. Locating edge 14 is placed against the reference line, for example, along the edge between vertical wall 43 and the floor of the room coinciding with plane 24. The floor covering to be cut to size, referred to by reference numeral 44 in FIG. 1, is laid upon auxiliary device 1 from supporting edge 10, over wedge-shaped portion 12, upon supporting surface 22, and beyond edge 16. Pressure is applied by strip 3 to ensure that covering 44 lies closely against the top surface of base section 2. A knife is then used to make a cut along cutting edge 16, whereupon the auxiliary device is removed and floor covering 44 is applied to the floor. Since the distance between supporting edge 10 and cutting edge 16, as measured along supporting surface 22, corresponds exactly to the distance between supporting edge 10 and locating edge 14, floor covering 44 will extend exactly to the edge between the floor and the wall.

FIG. 2 shows the same auxiliary device being used to paste wallpaper 46 to a wall surface 43. In this case, a skirting board 50 is arranged between floor surface 48 and wall surface 43. Paper 46 may be applied so that the lower edge thereof fits along the edge between wall surface 43 and top surface 52 of skirting board 50, in which case auxiliary device 1 will be used in the same manner as that shown in FIG. 1, except that supporting edge 10 and locating edge 14 lie against wall surface 43, with the locating edge 14 in the corner, defined between wall surface 43 and top surface 52 of skirting board 50.

On the other hand, the wallpaper may be required to cover not only wall surface 43 but also top surface 52 of skirting board 50, in which case the paper must be cut slightly longer. This is achieved in that foot 28 is provided, in its bottom surface defined by and facing plane 24, with an indentation in the form of a groove 54 running parallel with locating edge 14. The lateral surface 56 of groove 54 remote from locating edge 14, preferably is inclined parallel with outer surface 28 of foot 28. The distance between locating edge 14 and edge 58 at the bottom of lateral surface 56 corresponds to the desired extra length of the wallpaper.

If, as shown in FIG. 2, lateral surface 56 of groove 54 is applied to skirting board 50, instead of the locating edge 14, then paper 46, cut to size with auxiliary device 1 in this position., will be of a length such that it projects beyond the corner between wall 43 and top surface 52 of skirting board 50 and, then the paper 46 is applied to wall 43, the projection of the wallpaper will also cover top surface 52 of skirting board 50, as long as groove 54 is of the correct dimension. In case the wall or floor covering is required to be cut slightly longer, a second groove 60 may be provided, with a lateral surface 62 again running parallel with outer surface 29 of foot 28. In this case, the distance between locating edge 14 and the outer edge of lateral surface 58 may be ten millimeters, and the distance between locating edge 14 and the bottom edge of lateral surface 62 of second groove 60 may be twenty millimeters.

If the paper to be applied to wall surface 3 is thin, it is desirable for the wall surface 43 to be completely smooth, i.e. any irregularities must be eliminated and any depressions filled. This may be accomplished quickly and cleanly by using pressure strip 3 as a trowel, as shown in FIG. 3. If the strip 3 is applied to the wall in such a manner that wedge-shaped portion 12 forms an upwardly open angle with the wall surface, plaster 64 may be placed in this angle and may be applied to the wall, preferably by moving the pressure strip vertically up and down; the plaster being rolled in the gap between the pressure strip and the wall surface and being thus applied particularly uniformly thereto.

As may be gathered from the foregoing description, the object of the invention is an implement which is of simple design, is easy to produce, is reliable, has many applications, is easy to handle, will allow floor and wall covering to be cut cleanly and accurately to size, and may also be used to provide a smooth base for the covering.

While only several embodiments of the present invention have been shown and described, it will be obvious to those persons of ordinary skill in the art that many changes and modifications may be made thereunto without departing from the spirit and scope of the invention.

What is claimed is:

1. An auxiliary device for laying flexible wall and floor coverings, comprising:

an elongated angle plate including a supporting surface for the material to be cut to size, said supporting surface having at one end a wedge-shaped end portion, the outer edge of which defines a supporting edge, and a cutting edge defined at its opposite end, said cutting edge and supporting edge lying in a base plane, said angle plate also including a part having a locating edge disposed parallel to said cutting edge, said angle plate, in cross-section, lying substantially within an imaginary triangle, with its cutting edge, supporting edge and locating edge each passing through one corner of the triangle and with said supporting surface being disposed at an angle of inclination relative to said base plane, the portion of said supporting surface between said wedge-shaped end portion and said cutting edge thereof being disposed at a greater angle of inclination to said base plane than said wedge shaped edge portion, and the distance, as measured along said supporting surface, between said supporting edge and said locating edge being equal to the distance, as measured along said base plane between said supporting edge and said locating edge; and a pressure strip having a lower pressure surface of approximately that same length as said supporting surface of said angle plate, the cross-sectional profile of which is configured to complement the profile of said supporting surface.

2. The auxiliary device according to claim 1, wherein said part of said angle plate having said locating edge, is provided with at least one groove disposed parallel to said locating edge, and opening on said base plane extending between said supporting edge and said locating edge.

3. The auxiliary device according to claim 1, wherein said angle plate has a generally T-shaped configuration and includes a plate-like section on which said supporting surface is defined and a web-like leg secured to and extending from said plate-like section towards said locating edge (14).

4. The auxiliary device according to claim 3, wherein said part of said angle plate on which said locating edge is provided comprises a foot which is located at the free end of said leg.

5. The auxiliary device according to claim 4, wherein at least one groove disposed parallel to said locating edge and opening onto said base plane is provided in said foot.

6. The auxiliary device according to claim 3, additionally including a grip member secured to said angle plate and disposed between said plate-like section and said web-like leg and between said cutting edge and said locating edge, said grip member being disposed parallel to said cutting and said locating edges.

7. The auxiliary device according to claim 1, additionally including a grip member secured and arranged upon the side of the pressure strip remote from said pressure surface, said grip member being disposed parallel to said cutting edge.

8. The auxiliary device according to claim 1, wherein said angle plate and said pressure strip are made from a light metal alloy.

9. The auxiliary device according to claim 1, wherein a reinforcing strip made of hardened, high-grade steel, is embedded in said supporting surface of said angle plate along and adjacent to said cutting edge thereof.

* * * * *

UNITED STATES PATENT AND TRADEMARK OFFICE

CERTIFICATE OF CORRECTION

PATENT NO. : 4,143,463

DATED : Mar. 13, 1979

INVENTOR(S) : Erich Trankle

It is certified that error appears in the above-identified patent and that said Letters Patent are hereby corrected as shown below:

Column 2, line 58, after "plate", insert -- section --;

Column 2, line 58, delete "an" and insert -- angle --.

Claim 3, last line, delete "(14)".

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*